US012757981B2

(12) United States Patent
Miyazaki

(10) Patent No.: US 12,757,981 B2
(45) Date of Patent: Oct. 13, 2026

(54) SLIDER

(71) Applicant: YKK Corporation, Tokyo (JP)

(72) Inventor: Yohei Miyazaki, Toyama-ken (JP)

(73) Assignee: YKK Corporation, Tokyo (JP)

( * ) Notice: Subject to any disclaimer, the term of this patent is extended or adjusted under 35 U.S.C. 154(b) by 41 days.

(21) Appl. No.: 18/856,338

(22) PCT Filed: Apr. 25, 2022

(86) PCT No.: PCT/JP2022/018732
§ 371 (c)(1),
(2) Date: Oct. 11, 2024

(87) PCT Pub. No.: WO2023/209773
PCT Pub. Date: Nov. 2, 2023

(65) Prior Publication Data

US 2025/0248491 A1 Aug. 7, 2025

(51) Int. Cl.
*A44B 19/26* (2006.01)

(52) U.S. Cl.
CPC ..... *A44B 19/26* (2013.01)

(58) Field of Classification Search
CPC ... A44B 19/26; A44B 19/262; Y10T 24/2586; Y10T 24/2561
See application file for complete search history.

(56) References Cited

U.S. PATENT DOCUMENTS 2,657,445 A 11/1953 Weber
5,621,954 A * 4/1997 Mizuno ..... A44B 19/26 24/429
5,864,928 A 2/1999 Matsushima
(Continued)

FOREIGN PATENT DOCUMENTS

JP 51-004807 Y 2/1976
JP 60-070308 U1 5/1985
JP H02-59610 U 5/1990
(Continued)

OTHER PUBLICATIONS

International Preliminary Report on Patentability, PCT Patent Application No. PCT/JP2022/018732, mailed Oct. 29, 2024, 5 pages.
(Continued)

*Primary Examiner* — Jack W Lavinder
(74) *Attorney, Agent, or Firm* — Kilpatrick Townsend & Stockton LLP

(57) ABSTRACT

A slider includes: a slider body that guides elements in a front-rear direction; a pull tab holder that holds a shaft of a pull tab; and a closure member attached to the pull tab holder. The pull tab holder includes: a first end portion extending from the slider body; a body that defines a shaft-holding space with the slider body in which the shaft is disposed; and a second end portion that defines an insertion gap into which the shaft is insertable. The body includes a through hole penetrating through the body in the up-down direction; and a pair of side walls facing each other in the right-left direction across the through hole. The closure member includes: a base provided between the pair of side walls; and a first leg fitted to the insertion gap from a side of the shaft-holding space.

2 Claims, 6 Drawing Sheets

(56) References Cited

U.S. PATENT DOCUMENTS

| | | | | |
|---|---|---|---|---|
| 10,212,992 | B2 * | 2/2019 | Honda | A44B 19/26 |
| 2010/0186200 | A1 | 7/2010 | Chan | |

FOREIGN PATENT DOCUMENTS

| | | | | |
|---|---|---|---|---|
| JP | H08-266314 | A | 10/1996 | |
| WO | 2014/073111 | A1 | 5/2014 | |
| WO | WO-2016135873 | A1 * | 9/2016 | A44B 19/30 |

OTHER PUBLICATIONS

Japanese Patent Application No. 2024-517627, Office Action, Jul. 22, 2025, 6 pages.
International Search Report, PCT Patent Application No. PCT/JP2022/018732, mailed Jun. 21, 2022, 4 pages.
Written Opinion, PCT Patent Application No. PCT/JP2022/018732, mailed Jun. 21, 2022, 6 pages.
German Patent Application No. 112022007149.4, Office Action, Apr. 17, 2026, 10 pages.

* cited by examiner

SLIDER

TECHNICAL FIELD

The present invention relates to a slider used to open and close a slide fastener.

BACKGROUND ART

A slider to which a pull tab can be attached later is known as an exemplary slider used to open and close a slide fastener. For instance, a slider disclosed in Patent Literature 1 includes a slider body for guiding elements of a slide fastener in a front-rear direction, a pull tab holder that defines a holding space between the pull tab holder and the slider body, and a closure member fitted to an insertion gap formed in the pull tab holder. In this slider, a pull tab is attached thereto by inserting a shaft of the pull tab through the insertion gap of the pull tab holder to receive the shaft within the shaft-holding space and then fitting the closure member into the insertion gap.

CITATION LIST

Patent Literature(s)

Patent Literature 1: WO 2014/073111 A

SUMMARY OF THE INVENTION

Problem(s) to be Solved by the Invention

However, in the slider disclosed in Patent Literature 1, the closure member is attached to the pull tab holder from the outside (i.e. from a side opposite the shaft-holding space). The closure member may thus fall off from the pull tab holder due to a load applied through the shaft of the pull tab or interference from the outside. This may cause the pull tab to fall off from the slider.

An object of the invention is to provide a slider to which a pull tab can be attached later and that is capable of inhibiting the pull tab from falling off.

Means for Solving the Problem(s)

A slider according to a first aspect of the invention includes: a slider body configured to guide elements in a front-rear direction; a pull tab holder provided on a side of the slider body in an up-down direction orthogonal to the front-rear direction and configured to hold a shaft of a pull tab; and a closure member attached to the pull tab holder, in which the pull tab holder includes: a first end portion extending from the slider body along the up-down direction; a body extending from the first end portion along the front-rear direction, a shaft-holding space being defined between the body and the slider body in which the shaft is disposed; and a second end portion provided on a side of the body opposite the first end portion to face the slider body, an insertion gap being defined between the second end portion and the slider body into which the shaft is insertable, the body includes: a through hole penetrating through the body in the up-down direction; and a pair of side walls facing each other across the through hole in a right-left direction orthogonal to each of the front-rear direction and the up-down direction, and the closure member (4) includes: a base provided between the pair of side walls; and a first leg extending from the base to be fitted to the insertion gap from a side of the shaft-holding space.

In such an arrangement, the pull tab can be attached to the slider by inserting the shaft of the pull tab into the insertion gap of the pull tab holder to receive the shaft within the shaft-holding space and then attaching the closure member to the pull tab holder. Here, the base of the closure member is disposed inside the through hole of the pull tab holder (i.e. between the pair of side walls) and the first leg of the closure member extending from the base is fitted into the insertion gap from the shaft-holding space side. The closure member is thus unlikely to be susceptible to external interference and unlikely to fall off from the pull tab holder. It is thus possible to provide the slider to which the pull tab can be attached later and that is capable of inhibiting the pull tab from falling off.

In the first aspect of the invention, the side walls provided as the pair are each preferably in contact with the base in the right-left direction.

Such an arrangement can inhibit the base from being pulled out of the through hole. Accordingly, the closure member can be more effectively restrained from falling off.

In the first aspect of the invention, it is preferable that the pull tab holder includes a pair of front-rear opposing surfaces facing each other in the front-rear direction across the through hole, and the front-rear opposing surfaces provided as the pair are each in contact with the closure member in the front-rear direction.

Such an arrangement can inhibit the base from being pulled out of the through hole. Further, when the closure member receives a load including a component in the front-rear direction from the shaft of the pull tab, the pull tab holder can support the closure member via the front-rear opposing surface(s). Accordingly, the closure member can be more effectively restrained from falling off.

In the first aspect of the invention, it is preferable that one of the front-rear opposing surfaces provided as the pair is formed from the body to the second end portion and is in contact with each of the base and the first leg.

In such an arrangement, when the closure member receives a load including a component in the front-rear direction from the shaft of the pull tab, the pull tab holder can more effectively support the closure member via one of the front-rear opposing surfaces.

In the first aspect of the invention, it is preferable that a fitted portion open to the shaft-holding space is provided for the first end portion and that the closure member further includes a second leg extending from the base to be fitted to the fitted portion from the side of the shaft-holding space.

In such an arrangement, the first leg can be fitted to the insertion gap from the shaft-holding space side, and the second leg can be fitted to the fitted portion from the shaft-holding space side. Accordingly, the closure member can be more effectively restrained from falling off.

A slider according to a second aspect of the invention includes: a slider body configured to guide elements in a front-rear direction; a pull tab holder provided on a side of the slider body in an up-down direction orthogonal to the front-rear direction and configured to hold a shaft of a pull tab; and a closure member attached to the pull tab holder, in which the pull tab holder includes: a body extending along the front-rear direction, a shaft-holding space (S) being defined between the body and the slider body in which the shaft is disposed; a first end portion extending along the up-down direction from a first side of the body in the front-rear direction to be connected to the slider body, the first end portion being provided with a first fitted portion open to the shaft-holding space; and a second end portion extending along the up-down direction from a second side of the body in the front-rear direction to be connected to the slider body, the second end portion being provided with a second fitted portion open to the shaft-holding space, the body includes: a through hole penetrating through the body in the up-down direction; a pair of side walls facing each other across the through hole in a right-left direction orthogonal to each of the front-rear direction and the up-down direction; and an insertion gap in a form of slits, each of which separates a corresponding one of the side walls provided as the pair into a front portion and a rear portion in the front-rear direction, the shaft being insertable into the insertion gap, and the closure member includes: a base provided between the pair of side walls; and legs provided as a pair and extending from the base to be respectively fitted to the first fitted portion and the second fitted portion from a side of the shaft-holding space.

In such an arrangement, the pull tab can be attached to the slider by inserting the shaft of the pull tab into the insertion gap of the pull tab holder to receive the shaft within the shaft-holding space and then attaching the closure member to the pull tab holder. Here, the base of the closure member is disposed inside the through hole of the pull tab holder (i.e. between the pair of side walls) to close the insertion gap, and the legs provided as the pair of the closure member extend from the base to be respectively fitted to the first fitted portion and the second fitted portion from the shaft-holding space side. The closure member is thus unlikely to be susceptible to external interference and unlikely to fall off from the pull tab holder. It is thus possible to provide the slider to which the pull tab can be attached later and that is capable of inhibiting the pull tab from falling off.

DESCRIPTION OF EMBODIMENT(S)

A first exemplary embodiment of the invention will be described below with reference to FIGS. 1 to 5.

Figure 1:
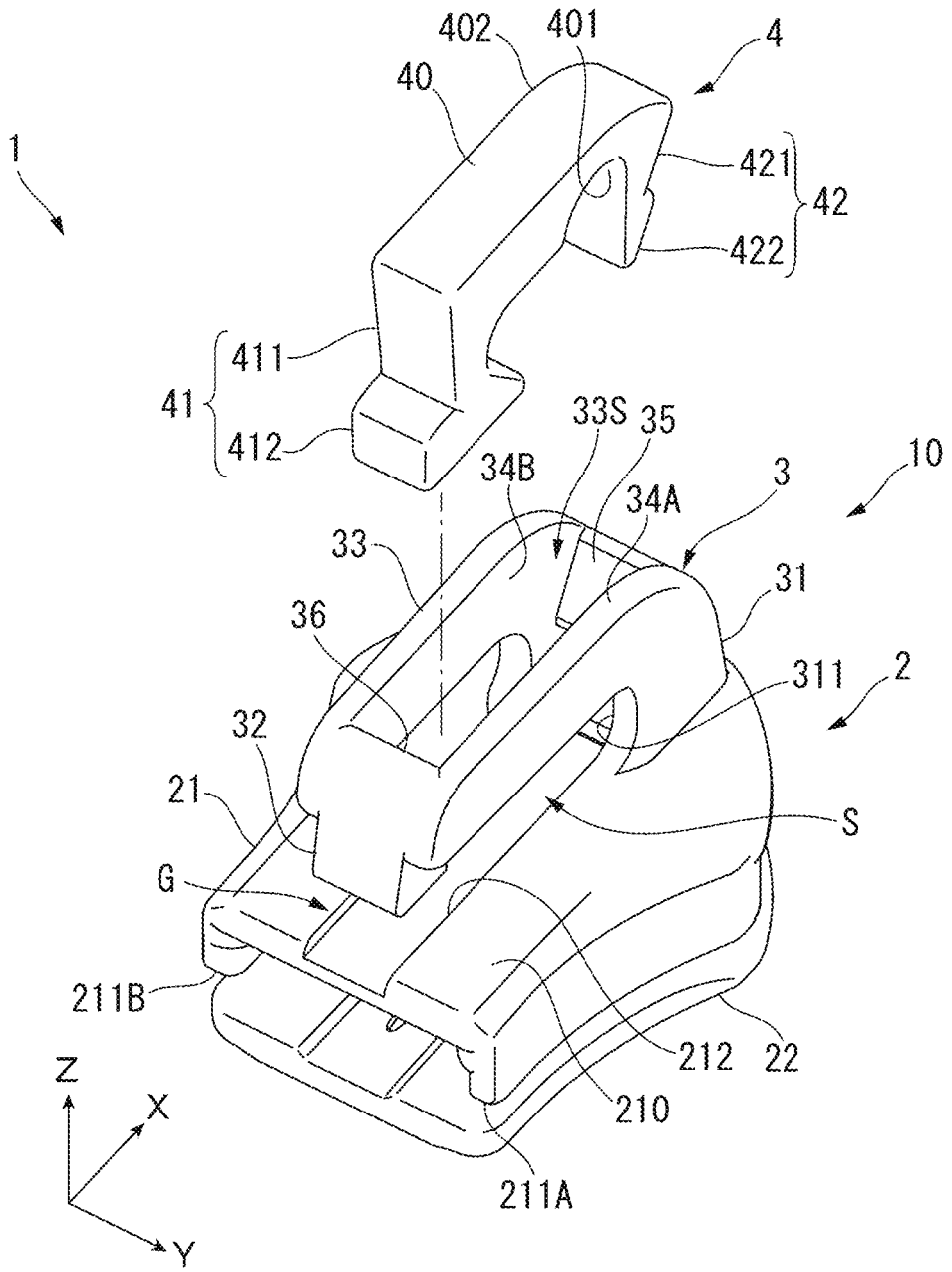
FIG. 1 is an exploded perspective view of a slider according to a first exemplary embodiment.

A slider 1 according to the exemplary embodiment is configured to guide a pair of elements (not illustrated) of a slide fastener in a guidance direction so that the pair of elements are fit to or separated from each other. As illustrated in FIG. 1, the slider 1 includes a slider body 2, a pull tab holder 3 standing upright on the slider body 2, and a closure member 4 attached to the pull tab holder 3.

Figure 5:
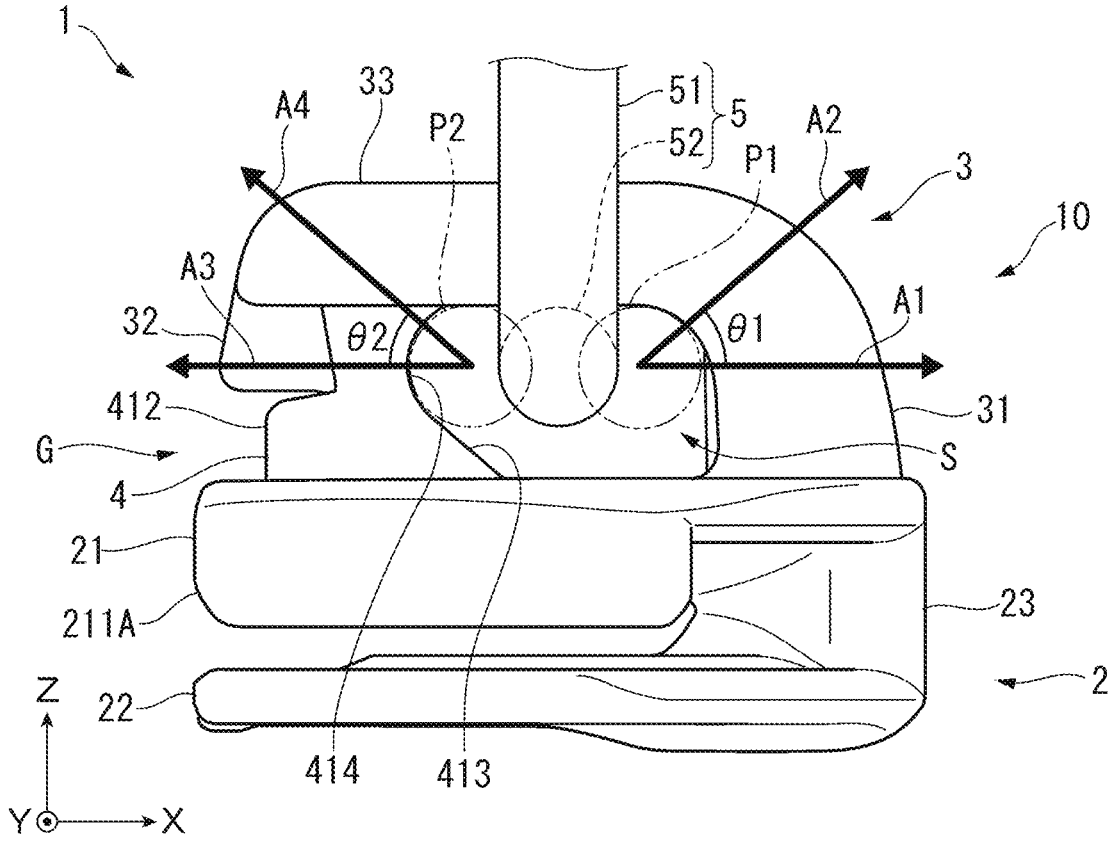
FIG. 5 is a side elevational view of the slider according to the first exemplary embodiment.

As illustrated in FIG. 5, a pull tab 5 for operating the slider 1 is attached to the slider 1. The pull tab 5 includes a pull tab body 51 configured to be held by a user and a shaft 52 provided at an end of the pull tab body 51.

Figure 2:
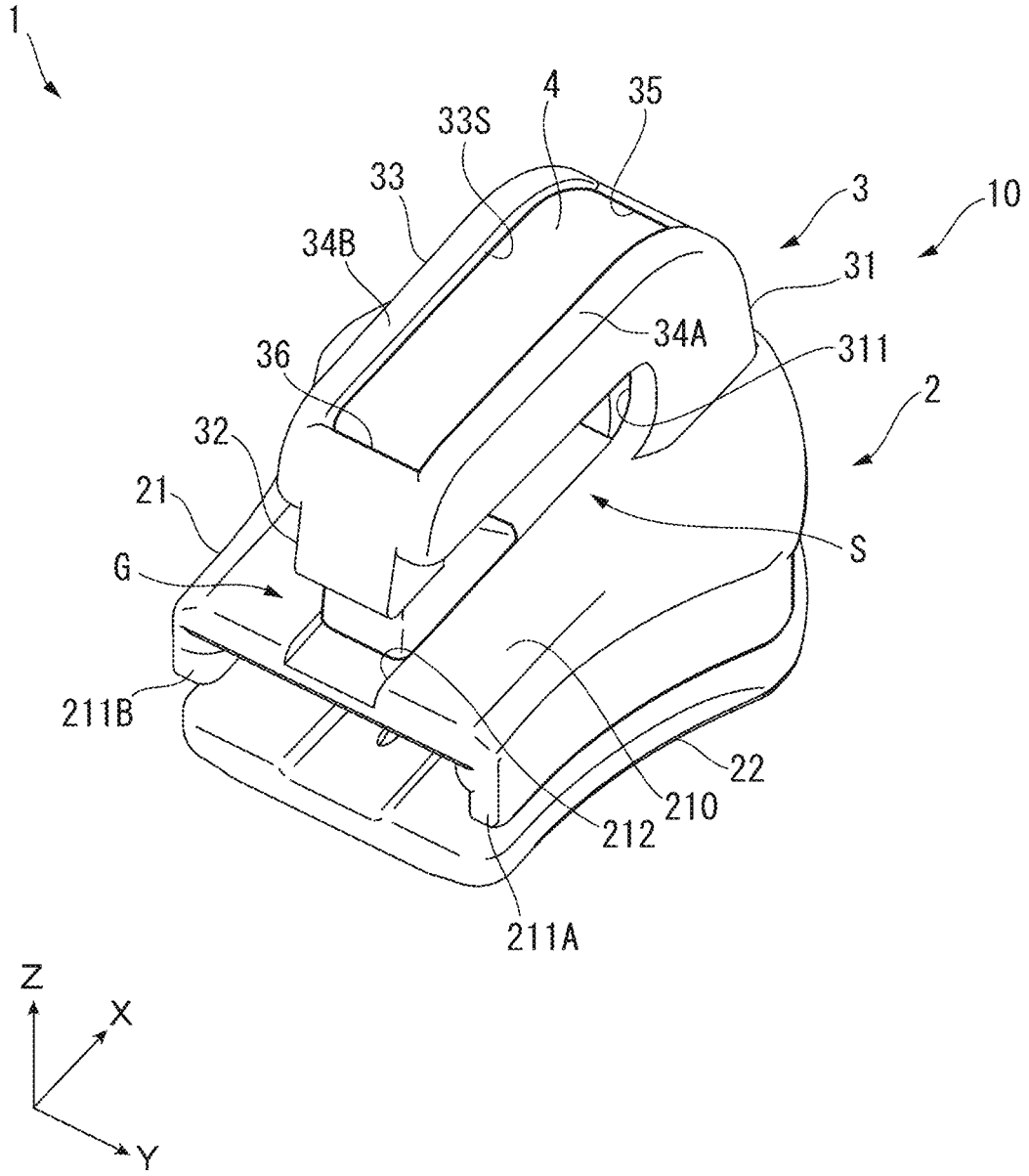
FIG. 2 is a perspective view of the slider according to the first exemplary embodiment.
Figure 3:
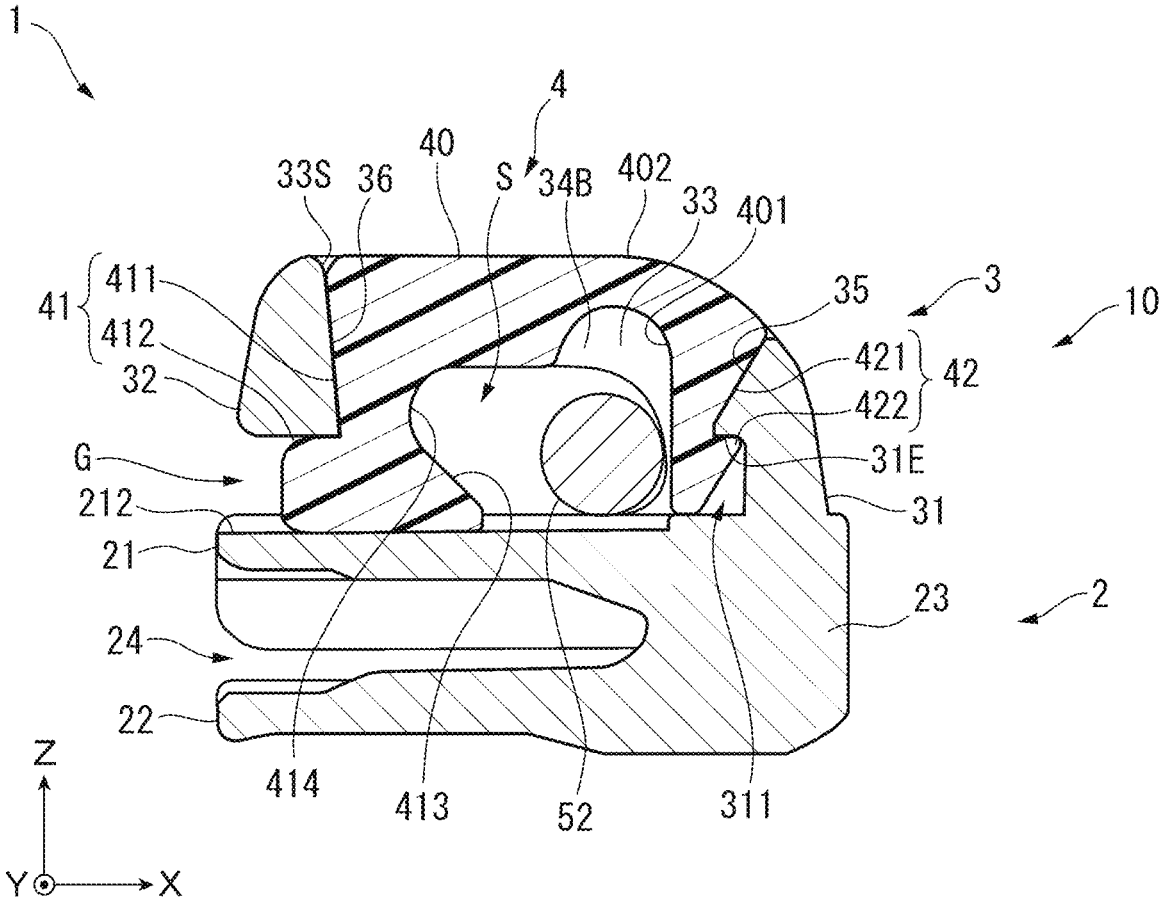
FIG. 3 is a cross-sectional view of the slider according to the first exemplary embodiment.

Referring to FIGS. 1 to 3, a structure of the slider 1 will be described. In the description below, a direction in which the slider 1 guides the elements is referred to as an X direction (a front-rear direction), a direction orthogonal to the X direction is referred to as a Y direction (a right-left direction), and a direction orthogonal to the X direction and the Y direction is referred to as a Z direction (an up-down direction, or a thickness direction of the slider body 2).

The slider body 2 is configured to guide an array of the pair of elements of the slide fastener in the X direction. Specifically, the slider body 2 includes an upper vane 21 and a lower vane 22 opposed each other in the Z direction and a guide post 23 connecting the upper vane 21 and the lower vane 22. A guide path 24, in which the array of the pair of elements of the slide fastener is inserted in a manner capable of being fit to or separated from each other, is formed between the upper vane 21 and the lower vane 22. A pair of flanges 211A and 211B opposed each other across the guide path 24 is provided for the upper vane 21.

The slider body 2, for which the same structure as a typical slider body is usable, will not be detailed herein. A groove 212 for receiving the closure member 4 described later extends in an upper surface 210 of the upper vane 21 along the X direction.

The slider body 2 of the exemplary embodiment is integrally molded with the pull tab holder 3 to form a slider main body 10. The slider main body 10, which is preferably a die-cast component, is optionally a molded product of a synthetic resin or the like.

The pull tab holder 3 stands on the upper vane 21 of the slider body 2 so that a shaft-holding space S, in which the shaft 52 of the pull tab 5 is disposed, is defined between the pull tab holder 3 and the upper vane 21. The shaft-holding space S is defined between the pull tab holder 3 and the slider body 2. The shaft 52 is capable of rotating within the shaft-holding space S around an axial center extending along the Y direction.

In the exemplary embodiment, the pull tab holder 3 includes a first end portion 31, a second end portion 32, and a body 33 extending between the first end portion 31 and the second end portion 32, the pull tab holder 3 defining a cantilever as a whole. The first end portion 31, which is a fixed end connected to an end of the upper vane 21 in a +X direction (e.g. a front end of the upper vane 21) and located at a side in the +X direction with respect to the shaft-holding space S, extends in a +Z direction from the upper vane 21. A groove 311 that is open to the shaft-holding space S (i.e. in a −X direction) and is communicated with a later-described through hole 33S of the body 33 is formed in the first end portion 31. In addition, a fitted portion 31E that is open to the shaft-holding space S through the groove 311 is formed in the groove 311 of the first end portion 31 (see FIG. 3). The fitted portion 31E may be a concave portion open to the shaft-holding space S or a hole open to the shaft-holding space S.

The second end portion 32, which is located at a side in the −X direction with respect to the shaft-holding space S, extends in a −Z direction from an end of the body 33 in the −X direction.

Specifically, the second end portion 32 of the exemplary embodiment is a free end facing the slider body 2 at a side of the body 33 opposite the first end portion 31, and an insertion gap G is formed between the second end portion 32 and an end of the upper vane 21 in the −X direction (e.g. a rear end portion of the upper vane 21). The insertion gap G is sized to allow the shaft 52 to be inserted into the shaft-holding space S.

A dimension in the Y direction (hereinafter also referred to as "Y-direction dimension") of the second end portion 32 is smaller than that of the body 33 and equal to that of the later-described through hole 33S formed in the body 33.

The body 33 extends between the first end portion 31 and the second end portion 32 along the X direction. The body 33 of the exemplary embodiment connects the first end portion 31 and the second end portion 32. The through hole 33S, which penetrates through the body 33 in the Z direction, is formed in the body 33 (see FIG. 1). The cross section of the through hole 33S is sized to have a predetermined dimension in the Y direction and elongated in the X direction. The body 33 thus defines a pair of side walls 34A and 34B facing each other in the Y direction across the through hole 33S. The side walls 34A and 34B are each in contact with a later-described base 40 of the closure member 4 in the Y direction.

In addition, the pull tab holder 3 is provided with a front side surface 35 and a rear side surface 36 facing each other in the X direction across the through hole 33S (corresponding to a pair of front-rear opposing surfaces of the invention). The front side surface 35, which extends from the body 33 to the first end portion 31, defines a part of a bottom of the groove 311 of the first end portion 31. The front side surface 35 also defines an inclined surface inclined in the Z direction so that a part in the +Z direction thereof is positioned in the +X direction from a part in the −Z direction thereof. The rear side surface 36 extends from the body 33 to the second end portion 32. The front side surface 35 is in contact with a later-described second leg 42 of the closure member 4. The rear side surface 36 is in contact with each of the base 40 and a later-described first leg 41 of the closure member 4.

The closure member 4 is, for instance, a molded synthetic resin product, and is preferably integrally formed from a flexible material. As illustrated in FIG. 1, the closure member 4 includes the base 40 and the first and second legs 41 and 42 extending from the base 40.

The closure member 4 is attached to the pull tab holder 3 to define the shaft-holding space S with the pull tab holder 3. The closure member 4 in a state of being attached to the pull tab holder 3 will be described below.

The base 40 is disposed within the through hole 33S of the pull tab holder 3 (i.e. between the pair of side walls 34A and 34B). The base 40 is in contact with the pair of side walls 34A and 34B in the Y direction and in contact with the rear side surface 36 in the X direction.

A semicircular groove 401 is formed along the Y direction at an end of the base 40 in the +X direction. The part of the base 40 provided with the groove 401 defines an elastically deformable flexible portion 402. The closure member 4 deforms so that ends of the first leg 41 and the second leg 42 approach each other mainly by the elastic deformation of the flexible portion 402.

The first leg 41 includes a leg body 411 extending in the −Z direction from an end of the base 40 in the −X direction and a fitting portion 412 extending in the −X direction from an end of the leg body 411. The leg body 411 extends along the second end portion 32 of the pull tab holder 3 to be in contact with the rear side surface 36 together with the base 40. The fitting portion 412 is fitted to the insertion gap G to be engaged with the second end portion 32.

Further, as illustrated in FIG. 3, a part of the first leg 41 facing the shaft-holding space S defines an inclined surface 413 inclined in the Z direction so that a part in the +Z direction thereof is positioned in the −X direction from a part in the −Z direction thereof. A semicircular concave portion 414 in which the shaft 52 can be disposed is formed between the inclined surface 413 and the base 40.

The second leg 42 includes a leg body 421 extending in the +X direction and −Z direction from the end of the base 40 in the +X direction and a fitting portion 422 extending in the +X direction from an end of the leg body 421. The leg body 421, which extends along the first end portion 31 while being in contact with the front side surface 35, is received into the groove 311. The fitting portion 422 is fitted to the fitted portion 31E to be engaged with the first end portion 31.

The first leg 41 and the second leg 42 are each configured to be insertable through the through hole 33S when the closure member 4 is attached to the pull tab holder 3. Specifically, the Y-direction dimension of each of the first leg 41 and the second leg 42 is not larger than the Y-direction dimension of a gap between the pair of side walls 34A and 34B (i.e. the through hole 33S).

A process for attaching the pull tab 5 to the slider 1 will be described below.

First, a worker prepares the slider main body 10 to which the closure member 4 is not yet attached, and then inserts the shaft 52 of the pull tab 5 into the insertion gap G of the pull tab holder 3. The shaft 52 is thus received in the shaft-holding space S.

Figure 4:
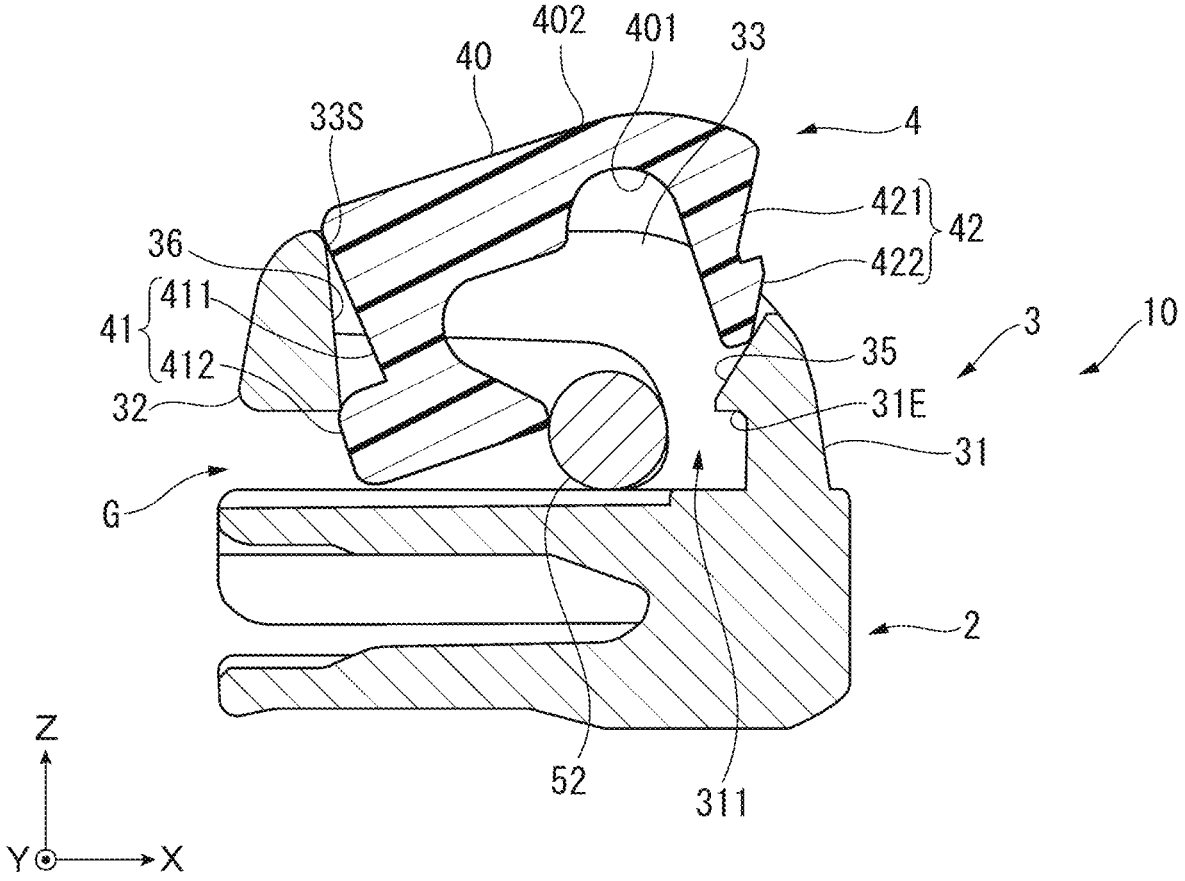
FIG. 4 illustrates an exemplary assembly process of the slider according to the first exemplary embodiment.

Subsequently, the worker attaches the closure member 4 to the pull tab holder 3 of the slider main body 10, as illustrated in FIG. 4. Specifically, after inserting the first leg 41 and the second leg 42 of the closure member 4 into the through hole 33S of the pull tab holder 3 to bring the fitting portion 412 of the first leg 41 into engagement with the insertion gap G, the base 40 is pushed into the through hole 33S. At this time, the second leg 42 is guided by the front side surface 35 to advance in the −Z direction while the flexible portion 402 of the closure member 4 is elastically deformed. When the second leg 42 has passed the front side surface 35, the flexible portion 402 restores its original shape, and the fitting portion 422 of the second leg 42 is fitted to the fitted portion 31E from the shaft-holding space S side. The fitting portion 412 of the first leg 41 is also fitted into the insertion gap G from the shaft-holding space S side.

After the closure member 4 is attached, the slider 1 can retain the pull tab 5 within the shaft-holding space S, as illustrated in FIG. 5.

Assuming that the slider 1 is slid in the +X direction, the shaft 52 of the pull tab 5 moves to a front position P1 in the shaft-holding space S to apply a load in a predetermined direction including a component in the +X direction to the slider 1. The "predetermined direction including a component in the +X direction" herein refers to a direction (see, for instance, an arrow A2 in FIG. 5) defined by, assuming that the +X direction is a reference direction (see, for instance, an arrow A1 in FIG. 5), rotating from the reference direction by a predetermined angle θ1 (e.g. 0 to 45 degrees) around the front position P1 in the +Z direction. In this case, the slider 1 can receive the load applied from the shaft 52 at the pull tab holder 3 (specifically, the first end portion 31 or the pair of side walls 34A, 34B).

When the slider 1 is slid in the −X direction, the shaft 52 of the pull tab 5 is guided by the inclined surface 413 to be moved to a rear position P2 (i.e. in the concave portion 414 of the closure member 4) to apply a load in a predetermined direction including a component in the −X direction to the slider 1. The "predetermined direction including a component in the −X direction" herein refers to a direction (see, for instance, an arrow A4 in FIG. 5) defined by, assuming that the −X direction is a reference direction (see, for instance, an arrow A3 in FIG. 5), rotating from the reference direction by a predetermined angle θ2 (e.g. 0 to 45 degrees) around the front position P2 in the +Z direction. In this case, the slider 1 can receive the load applied from the shaft 52 at the pull tab holder 3 (specifically, the second end portion 32 or the pair of side walls 34A, 34B) via the closure member 4.

Further, the pull tab 5 can be removed from the slider 1 in the exemplary embodiment.

When removing the pull tab 5 from the slider 1, a predetermined tool is inserted into the insertion gap G to push the fitting portion 412 of the first leg 41 out into the shaft-holding space S. The closure member 4 is thus elastically deformed, so that a part of the base 40 is pushed out of the pull tab holder 3 through the through hole 33S. A worker can hold the part of the base 40 pushed out of the through hole 33S and pull the closure member 4 out of the through hole 33S. Subsequently, the worker can remove the pull tab 5 from the pull tab holder 3 through the insertion gap G. Alternatively, a new pull tab 5 is optionally attached to replace the pull tab 5.

Effects of the first exemplary embodiment will be described below.

As described above, according to the slider 1 of the exemplary embodiment, the pull tab 5 can be attached by inserting the shaft 52 of the pull tab 5 into the insertion gap G of the pull tab holder 3 to receive the shaft 52 within the shaft-holding space S and then attaching the closure member 4 to the pull tab holder 3.

The base 40 of the closure member 4 is disposed inside the through hole 33S of the pull tab holder 3 (i.e. between the pair of side walls 34A and 34B) and the first leg 41 of the closure member 4 extending from the base 40 is fitted into the insertion gap G from the shaft-holding space S side to close the insertion gap G. The closure member 4 is thus unlikely to be susceptible to external interference and unlikely to fall off from the pull tab holder 3. Accordingly, it is possible to provide the slider 1 to which the pull tab 5 can be attached later and that is capable of inhibiting the pull tab 5 from falling off.

In addition, the pair of side walls 34A and 34B can also receive the load applied on the pull tab 5 in the Y direction.

In the exemplary embodiment, the side walls 34A and 34B are each in contact with the base 40 in the Y direction. This arrangement inhibits the base 40 from being pulled out of the through hole 33S. Accordingly, the closure member 4 can be more effectively restrained from falling off.

In the exemplary embodiment, the pull tab holder 3 includes the front side surface 35 and the rear side surface 36 (the pair of front-rear opposing surfaces of the invention) facing each other in the X direction across the through hole 33S, and each of the front side surface 35 and the rear side surface 36 is in contact with the closure member 4 in the X direction. This arrangement inhibits the base 40 from being pulled out of the through hole 33S. Further, when the closure member 4 receives a load including the component in the X direction from the shaft 52 of the pull tab 5, the pull tab holder 3 can support the closure member 4 via the front side surface 35 or the rear side surface 36. Accordingly, the closure member 4 can be more effectively restrained from falling off.

In the exemplary embodiment, the rear side surface 36 is formed from the body 33 to the second end portion 32 and is in contact with each of the base 40 and the first leg 41. In such an arrangement, when the closure member 4 receives a load including the component in the X direction from the shaft 52 of the pull tab 5, the pull tab holder 3 can more effectively support the closure member 4 via the rear side surface 36.

In the exemplary embodiment, it is preferable that the fitted portion 31E open to the shaft-holding space S is provided for the first end portion 31 and the closure member 4 is further provided with the second leg 42 extending from the base 40 to be fitted to the fitted portion 31E from the shaft-holding space S side.

In such an arrangement, the first leg 41 can be fitted to the insertion gap G from the shaft-holding space S side, and the second leg 42 can be fitted to the fitted portion 31E from the shaft-holding space S side. Accordingly, the closure member 4 can be more effectively restrained from falling off.

Second Exemplary Embodiment

Figure 6:
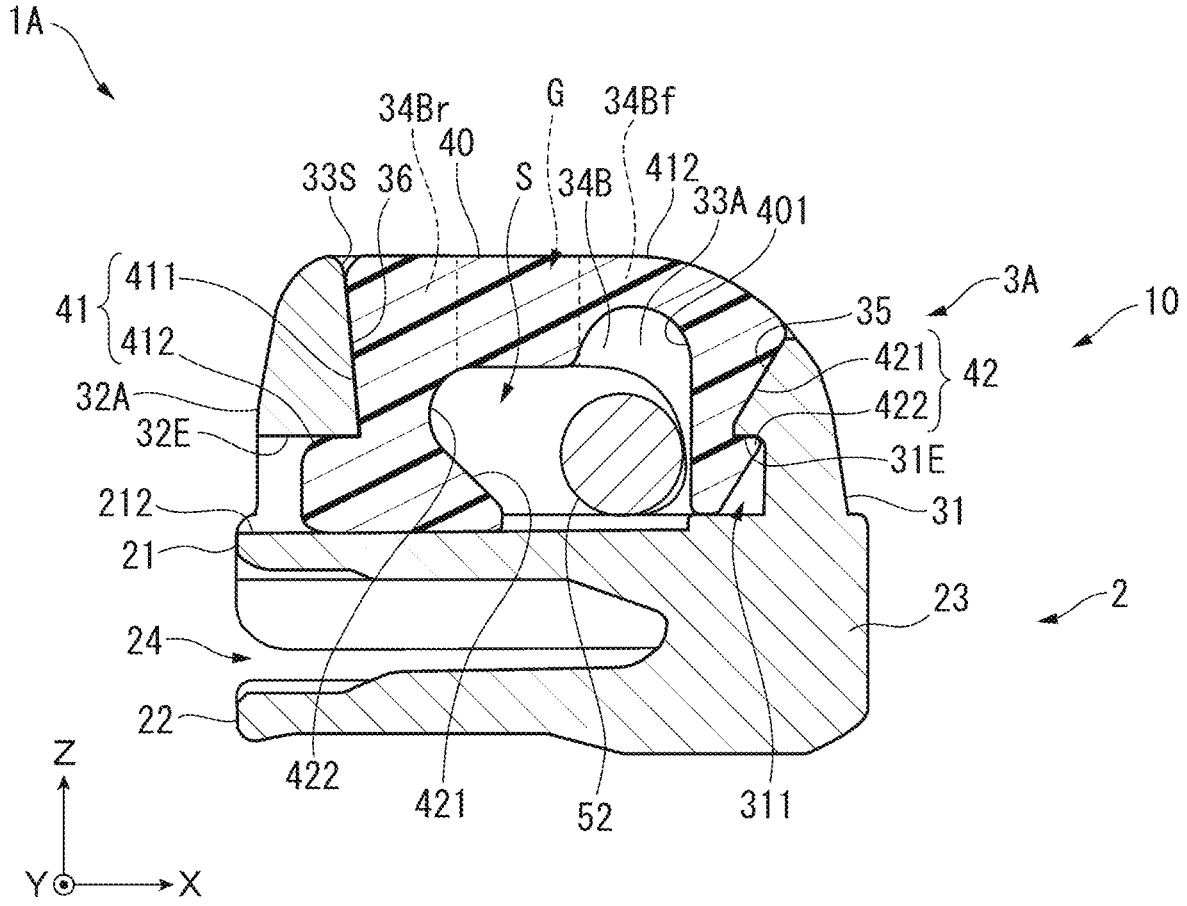
FIG. 6 is a cross-sectional view of the slider according to a second exemplary embodiment.

Referring to FIG. 6, a second exemplary embodiment of the invention will be described below.

A slider 1A of the second exemplary embodiment is different from the slider in the first exemplary embodiment mainly in the location of the insertion gap G. In the following, components that are the same or substantially the same as those of the first exemplary embodiment are denoted by the same reference numerals, and the description thereof is omitted or simplified.

As in the first exemplary embodiment, the slider 1A according to the second exemplary embodiment includes the slider body 2, a pull tab holder 3A that defines the shaft-holding space S between the pull tab holder 3A and the slider body 2 in which the shaft 52 of the pull tab 5 is disposed, and the closure member 4 attached to the pull tab holder 3A.

The pull tab holder 3A includes a body 33A extending along the X direction to define the shaft-holding space S between the body 33A and the slider body 2, the first end portion 31 that extends in the Z direction from an end of the body 33A in the +X direction to be connected to the slider body 2 and that is provided with a first fitted portion 31E open to the shaft-holding space S, and a second end portion 32A that extends in the Z direction from an end of the body 33A in the −X direction to be connected to the slider body 2 and that is provided with a second fitted portion 32E open to the shaft-holding space S.

The second end portion 32A of the second exemplary embodiment is not a free end but is a fixed end. The second fitted portion 32E provided for the second end portion 32A may be a hole open to the shaft-holding space S or a concave portion open to the shaft-holding space S.

The body 33A has the through hole 33S as in the first exemplary embodiment. The body 33A includes the pair of side walls 34A and 34B facing each other across the through hole 33S.

The body 33A is also provided with the insertion gap G in a form of slits that are located to overlap the through hole 33S and that are configured to separate the side walls 34A and 34B provided as a pair into a front portion and a rear portion in the X direction. Of the side walls 34A and 34B provided as a pair, FIG. 6 illustrates a front portion 34Bf and a rear portion 34Br of the side wall 34B.

As in the first exemplary embodiment, the closure member 4 includes the base 40, the first leg 41, and the second leg 42. It should however be noted that the first leg 41 is fitted not to the insertion gap G but to the second fitted portion 32E from the shaft-holding space S side.

In the second exemplary embodiment, the base 40 of the closure member 4 is disposed inside the through hole 33S of the pull tab holder 3A (i.e. between the pair of side walls 34A and 34B) to close the insertion gap G, and the first leg 41 and the second leg 42 (the pair of legs) of the closure member 4 extend from the base 40 to be fitted to the second fitted portion 32E and the first fitted portion 31E, respectively, from the shaft-holding space S side. The closure member 4 is thus unlikely to be susceptible to external interference and unlikely to fall off from the pull tab holder 3A.

According to the second embodiment, as in the first exemplary embodiment, it is possible to provide the slider 1A to which the pull tab 5 can be attached later and that is capable of inhibiting the pull tab 5 from falling off.

Modifications

In the first exemplary embodiment, the second end portion 32 of the pull tab holder 3 may be an end portion of the body 33 extending in the X direction (i.e. an end portion in the −X direction).

In each of the above exemplary embodiments, the first end portion 31 of the pull tab holder 3 (3A) may not be provided with the groove 311, and the fitted portion 31E (or the first fitted portion 31E) may be provided for an inner side of the first end portion 31.

In each of the above exemplary embodiments, the closure member 4 is in contact with both sides of the pull tab holder 3 (3A) in the X direction and in the Y direction. The closure member 4, however, may not be in contact with the pull tab holder 3 (3A) in one of the X and Y directions.

In each of the above exemplary embodiments, the slider body 2 and the pull tab holder 3 (3A) may be assembled to form the slider main body 10 after being independently molded.

The invention claimed is:

1. A slider, comprising:

a slider body configured to guide elements in a front-rear direction;

a pull tab holder provided on a side of the slider body in an up-down direction orthogonal to the front-rear direction and configured to hold a shaft of a pull tab; and a closure member attached to the pull tab holder, wherein the pull tab holder includes:

a first end portion extending from the slider body along the up-down direction;

a body extending from the first end portion along the front-rear direction, a shaft-holding space being defined between the body and the slider body in which the shaft is disposed; and a second end portion provided on a side of the body opposite the first end portion to face the slider body, an insertion gap being defined between the second end portion and the slider body into which the shaft is insertable, the body includes:

a through hole penetrating through the body in the up-down direction; and a pair of side walls facing each other across the through hole in a right-left direction orthogonal to each of the front-rear direction and the up-down direction, and the closure member includes:

a base configured to fit between the pair of side walls; and a first leg extending from the base and configured to be fitted through the through hole and into the insertion gap from a side of the shaft-holding space, wherein the closure member is configured to be inserted through the through hole in the up-down direction, wherein the pull tab holder includes a pair of front-rear opposing surfaces facing each other in the front-rear direction across the through hole, and the front-rear opposing surfaces provided as the pair of front-rear opposing surfaces are each in contact with the closure member in the front-rear direction, and wherein one of the front-rear opposing surfaces provided as the pair of front-rear opposing surfaces is formed from the body to the second end portion and is in contact with each of the base and the first leg.

2. The slider according to claim 1, wherein a fitted portion open to the shaft-holding space is provided for the first end portion, and the closure member further includes a second leg extending from the base and configured to be fitted to the fitted portion from the side of the shaft-holding space.

* * * * *